US012232598B2

(12) United States Patent
Hales et al.

(10) Patent No.: US 12,232,598 B2
(45) **Date of Patent: *Feb. 25, 2025**

(54) POOL AND SPA WATER HAMMOCK DEVICE AND METHODS OF USE

(71) Applicant: BULLFROG INTERNATIONAL, LC, Herriman, UT (US)

(72) Inventors: Eric Hales, Eagle Mountain, UT (US); Mark McLane, Lehi, UT (US); Robert Santos, Daybreak, UT (US); Richard Eddington, South Jordan, UT (US)

(73) Assignee: Bullfrog International, LC, Herriman, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/138,390

(22) Filed: Apr. 24, 2023

(65) Prior Publication Data

US 2023/0329425 A1 Oct. 19, 2023

Related U.S. Application Data

(63) Continuation of application No. 17/351,130, filed on Jun. 17, 2021, now Pat. No. 11,638,475.

(51) Int. Cl.
*A45F 3/22* (2006.01)
*A45F 3/24* (2006.01)
(Continued)

(52) U.S. Cl.
CPC ..... *A45F 3/22* (2013.01); *A45F 3/24* (2013.01); *E04H 4/14* (2013.01); *E04H 4/00* (2013.01)

(58) Field of Classification Search
CPC ..... A45F 3/22; A45F 4/24; A45F 3/24; E04H 4/14; E04H 4/40; E04H 4/00; A47K 3/12; A47K 3/125; A47K 3/127
(Continued)

(56) References Cited

U.S. PATENT DOCUMENTS 975,016 A 11/1910 Buerger
1,369,638 A 2/1921 Edmonds et al.
(Continued)

FOREIGN PATENT DOCUMENTS

CA 2398859 A1 2/2003
CN 201641795 U 11/2010
(Continued)

OTHER PUBLICATIONS

Canadian Patent Office, "Examiner's Report," Canadian Application No. 3,163,207, Sep. 6, 2023.
(Continued)

*Primary Examiner* — Robert G Santos
(74) *Attorney, Agent, or Firm* — Dentons Durham Jones Pinegar; Sarah W. Matthews

(57) ABSTRACT

A system and method for providing a hammock for a user to rest thereon in the water of the spa. The hammock may include a proximal end with head support portion and one or more attachment means for connection to an anchor on the spa shell, and a distal end with one or more attachment means for connection to an anchor on the spa shell. One or more lateral coupling members may couple the hammock to the lateral sides of the spa, and one or more longitudinal coupling members may couple the hammock to a front side and/or back side of the spa. The longitudinal and lateral coupling members may support the hammock in the water to give the user a unique flotation experience.

15 Claims, 8 Drawing Sheets

(51) Int. Cl.
*E04H 4/00* (2006.01)
*E04H 4/14* (2006.01)

(58) Field of Classification Search
USPC ..... 5/120, 122, 123, 127; 4/572.1, 573.1, 4/574.1, 575.1
See application file for complete search history.

(56) References Cited

U.S. PATENT DOCUMENTS

| | | | | |
|---|---|---|---|---|
| 1,450,827 | A | 4/1923 | Wood | |
| 1,734,462 | A | 11/1929 | Gottlieb | |
| 2,089,801 | A | 8/1937 | Kennedy | |
| 2,358,003 | A | 9/1944 | Puy | |
| 2,514,767 | A | 7/1950 | Kennedy | |
| 2,644,953 | A | 7/1953 | Kennedy | |
| 3,595,224 | A | 7/1971 | Walter | |
| 4,192,024 | A | 3/1980 | Zigmont | |
| 4,777,674 | A | 10/1988 | Payton et al. | |
| 5,285,539 | A | 2/1994 | Anderson et al. | |
| 5,491,850 | A | 2/1996 | Kiester | |
| 5,809,588 | A | 9/1998 | Angelotti | |
| 11,638,475 | B2 * | 5/2023 | Hales | E04H 4/14 5/120 |
| 2003/0037369 | A1 | 2/2003 | Maynard et al. | |
| 2022/0400838 | A1 * | 12/2022 | Hales | E04H 4/14 |
| 2023/0329425 | A1 * | 10/2023 | Hales | A61H 37/005 |

FOREIGN PATENT DOCUMENTS

| | | | | |
|---|---|---|---|---|
| EP | 4104808 | A1 * | 12/2022 | A45F 3/22 |
| RU | 2576089 | C1 | 2/2016 | |

OTHER PUBLICATIONS

IP Australia, "Examination report No. 1," Australian Application No. 2022204204, Jun. 30, 2023.

European Patent Office, "European Extended Search Report," European Application No. 22178271.7, Nov. 10, 2022.

* cited by examiner

POOL AND SPA WATER HAMMOCK DEVICE AND METHODS OF USE

CROSS REFERENCE TO RELATED APPLICATIONS

The present application is a continuation of U.S. patent application Ser. No. 17/351,130, entitled POOL AND SPA WATER HAMMOCK DEVICE AND METHODS OF USE, filed Jun. 17, 2021 (the '130 application) now U.S. Pat. No. 11,638,475, issued May 2, 2023. The entire disclosures of the '130 application is hereby incorporated herein.

TECHNICAL FIELD

The present disclosure relates generally to a system and method for body-supporting devices specially adapted for water sports or water leisure. More specifically, the present disclosure relates to a method and apparatus for providing a hammock for use within a pool or spa.

BACKGROUND

Floating articles which can be used in a swimming pool for a person to rest on include floating mattresses and inflatable tubs, etc. Supported floating within water can be even more enjoyable than floating above water. For example, zero gravity flotation is known to have a number of health benefits and provides a deeply relaxing floating experience. Zero gravity flotation typically requires a special pool with a high concentration of salt. It may be desirable to simulate a zero gravity flotation experience in a standard pool or spa, and also provide for other recreational experiences within a pool or spa.

SUMMARY OF DISCLOSURE

According to the present disclosure, a spa user support system may comprise a swim spa comprising a generally rectangular shell, the generally rectangular shell including a front side having at least one swim jet in connection therewith, a back side opposite the front side, with a first lateral side between the front side and the back side, and a second lateral side opposite the first lateral side and between the front side and the back side. The system may also include a first anchor permanently attached to the generally rectangular shell and a second anchor permanently attached to the generally rectangular shell. The system may further include a user support hammock, the user support hammock having at least two sides. A first side of the user support hammock may include a head support portion, and the first side may be in connection with a first attachment means for attaching the first side to the first anchor. A second side of the user support hammock may be in connection with a second attachment means for attaching the second side to the second anchor.

In some configurations, the first anchor comprises an attachment loop, the second anchor comprises a first sleeve, and a third anchor comprises a second sleeve. The first side of the user support hammock may include an attachment member for attachment to the attachment loop of the first anchor. The second side of the user support hammock may be in connection with a first pin, with the first pin receivable within the first sleeve of the second anchor. The third side of the user support hammock may be in connection with a second pin, with the second pin receivable within the second sleeve of the third anchor.

According to another aspect, the user support hammock may have a generally triangular shape with a head support portion at a first corner, with the first corner further comprising a loop for attachment to a longitudinal coupling member. A second corner of the user support hammock may comprise a loop for attachment to a first lateral coupling member. A third corner of the user support hammock may comprise a loop for attachment to a second lateral coupling member.

In yet another configuration, the user support hammock may have a generally rectangular shape. The swim spa may further comprise a fourth anchor permanently attached to the back side of the spa, such that the head support portion is connectable via a first longitudinal coupling member to the first anchor of the back side of the swim spa. The head portion may be further connectable via a second longitudinal coupling member to the fourth anchor of the back side of the swim spa. In some configurations, the anchors may be permanently attached to the back side by being bolted directly through the generally rectangular shell of the swim spa.

According to another aspect, the user support hammock comprises a water permeable material. The head support portion may comprise at least one support member to increase rigidity of the head support portion. The head support portion may also comprise a pillow member to support a user's head.

In some configurations, the support hammock is attached to at least six anchors on the spa shell to limit swaying of the support hammock in use. For example, two anchors may be connected to a vertical wall of the back side of the spa shell, another anchor may be connected to a horizontal lip of a first lateral side, another anchor may be connected to a horizontal lip of the second lateral side, and two anchors may be connected to the vertical wall of the front side of the spa shell.

According to another aspect, a first attachment means comprises a longitudinal coupling member, and the second and third attachment means each comprise a lateral coupling member. In some configurations, the support hammock is attached to at least two longitudinal coupling members and at least two lateral coupling members to limit swaying of the support hammock in use.

According to yet another aspect, a spa user support system may comprise a user support hammock for a user to rest thereon in the water of the spa. The user support hammock may comprise a head support portion at a proximal end, with the proximal end comprising a first attachment means at a first proximal corner for longitudinal connection to a first anchor on a first end of a spa shell. The user support hammock may further comprise a distal end opposite the proximal end, with the distal end comprising a second attachment means at a first distal corner for connection to a second anchor on a first lateral side of the spa shell, and a third attachment means at a second distal corner for connection to a third anchor on a second lateral side of the spa shell.

BRIEF DESCRIPTION OF DRAWINGS

The following drawings illustrate what are currently considered to be specific representative configurations for carrying out the invention and are not limiting as to embodiments which may be made in accordance with the present invention. The components in the drawings are not necessarily to scale relative to each other. Like reference numerals designate corresponding parts throughout the several views.

The drawings are illustrative and not limiting of the scope of the invention which is defined by the appended claims. The various elements of the invention accomplish various aspects and objects of the invention. Not every element of the invention can be clearly displayed in a single drawing, and as such not every drawing shows each element of the invention.

DETAILED DESCRIPTION

Figure 1:
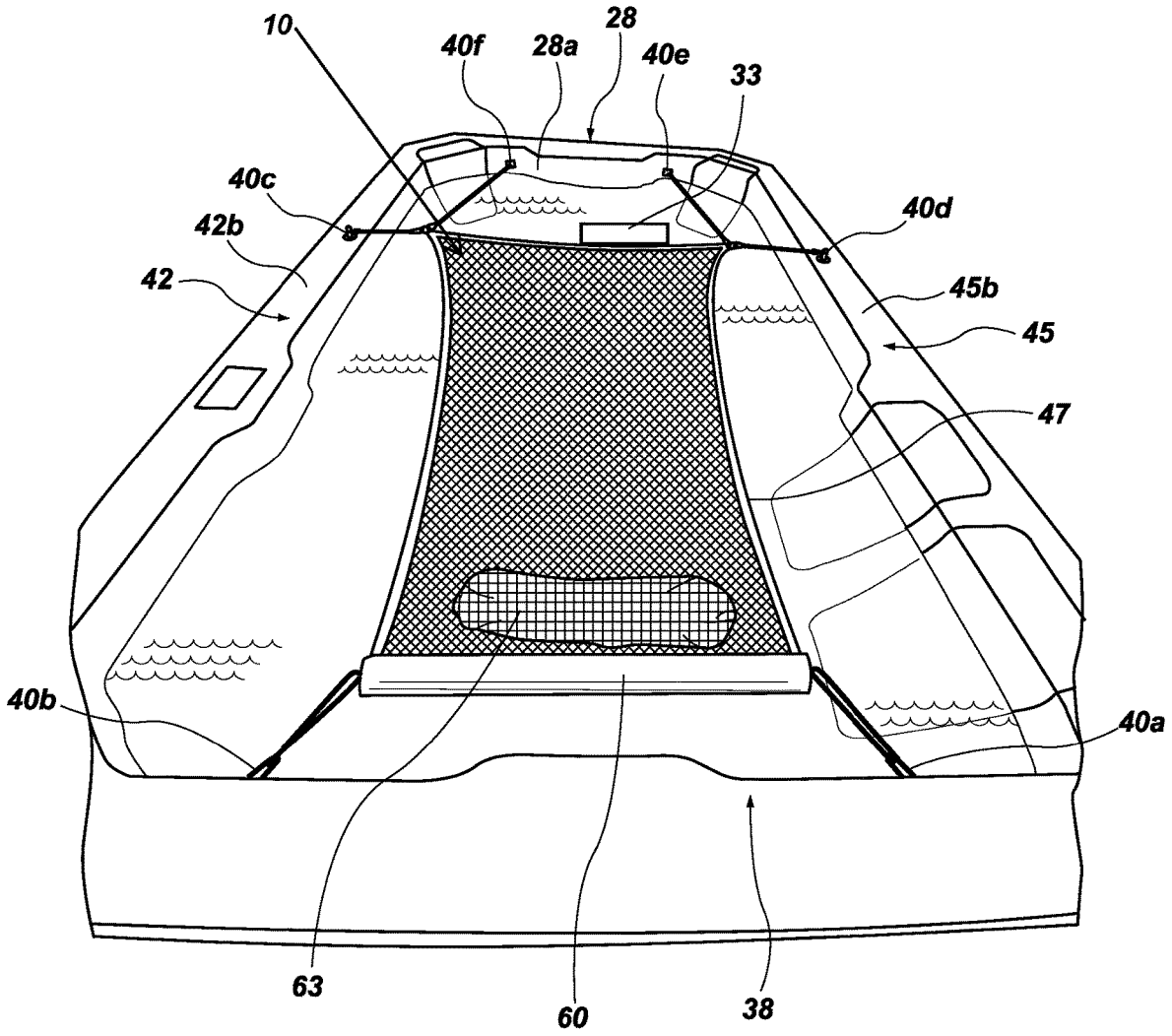
FIG. 1 is a top, front perspective view of a user support hammock system as described herein.

The following provides a detailed description of particular embodiments of the present invention. Reference will now be made to the drawings in which the various elements of the illustrated configurations will be given numerical designations and in which the invention will be discussed so as to enable one skilled in the art to make and use the invention. It is to be understood that the following description is only exemplary of the principles of the present invention, and should not be viewed as narrowing the scope of the claims which follow, which claims define the full scope of the invention.

It will be appreciated that various aspects discussed in one drawing may be present and/or used in conjunction with the embodiment shown in another drawing, and each element shown in multiple drawings may be discussed only once. For example, in some cases, detailed description of well-known items or repeated description of substantially the same configurations may be omitted. This facilitates the understanding of those skilled in the art by avoiding an unnecessarily redundant description. The accompanying drawings and the following description are provided in order for those skilled in the art to fully understand the present disclosure, and these are not intended to limit the scope of claims. All statements herein reciting principles, aspects, and embodiments of the invention, as well as specific examples thereof, are intended to encompass equivalents thereof.

Reference in the specification to "one configuration" "one embodiment," "a configuration" or "an embodiment" means that a particular feature, structure, or characteristic described in connection with the configuration is included in at least one configuration, but is not a requirement that such feature, structure or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

Furthermore, the described features, structures, or characteristics of configurations of the invention may be combined in any suitable manner in one or more configurations. In the following description, numerous specific details are provided, such as examples of products or manufacturing techniques that may be used, to provide a thorough understanding of configurations of the invention. One skilled in the relevant art will recognize, however, that configurations of the invention may be practiced without one or more of the specific details, or with other methods, components, materials, and so forth. In other instances, well-known structures, materials, or operations are not shown or described in detail to avoid obscuring aspects of the invention.

As used in this specification and the appended claims, singular forms such as "a," "an," and "the" may include the plural unless the context clearly dictates otherwise. Thus, for example, reference to "an anchor" may include one or more of such anchors, and reference to "the coupling member" may include reference to one or more of such coupling members.

As used herein, the term "substantially" refers to the complete or nearly complete extent or degree of an action, characteristic, property, state, structure, item, or result to function as indicated. For example, a hammock that is "substantially" rectangular may be either completely rectangular or nearly completely rectangular. The use of "substantially" is equally applicable when used in a negative connotation to refer to the complete or near complete lack of an action, characteristic, property, state, structure, item, or result. As used herein the term "generally" refers to something that is more of the designated adjective than not, or the converse if used in the negative. As used herein, the term "about" is used to provide flexibility to a numerical range endpoint by providing that a given value may be "a little above" or "a little below" the endpoint while still accomplishing the function associated with the range. As used herein, a plurality of items, structural elements, compositional elements, and/or materials may be presented in a common list for convenience. However, these lists should be construed as though each member of the list is individually identified as a separate and unique member.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 5 to about 60" should be interpreted to include not only the explicitly recited values of about 1 to about 5, but also include individual values and sub-ranges within the indicated range. Thus, included in this numerical range are individual values such as 6, 7, 8, 9, etc., through 60, and sub-ranges such as from 10-20, from 30-40, and from 50-60, etc., as well as each number individually. This same principle applies to ranges reciting only one numerical value as a minimum or a maximum. Furthermore, such an interpretation should apply regardless of the breadth of the range or the characteristics being described. Additionally, the word "connected" and "coupled" is used throughout for clarity of the description and can include either a direct connection or an indirect connection.

The present disclosure relates generally to a system and method for providing hammock or user support for use in conjunction with a spa, swim spa, pool, etc. As used herein, "spa" refers to a hot tub, swim spa, and/or a jetted tub, whether in ground or above ground. It will be appreciated that while the user support system described herein is described in reference to a spa, it may be similarly used in conjunction with a pool or other swimming system and may even potentially have use in other water sources such as lakes, rivers, or oceans with proper securing features. Similarly "spa shell" refers to the outer shell or structure of the spa, and encompasses the outer structure of a spa or any other swimming vessel, such as the outer structure of a pool, etc. Thus, "spa shell" means both the shell of a spa, the deck of a pool, and other equivalents. As used herein, "hammock" refers to a user support which may support a user and which may be suspended at one or more ends and/or sides such that it may be capable of swinging or not capable of swinging depending on the user's desire and the attachment means used.

Figure 2:
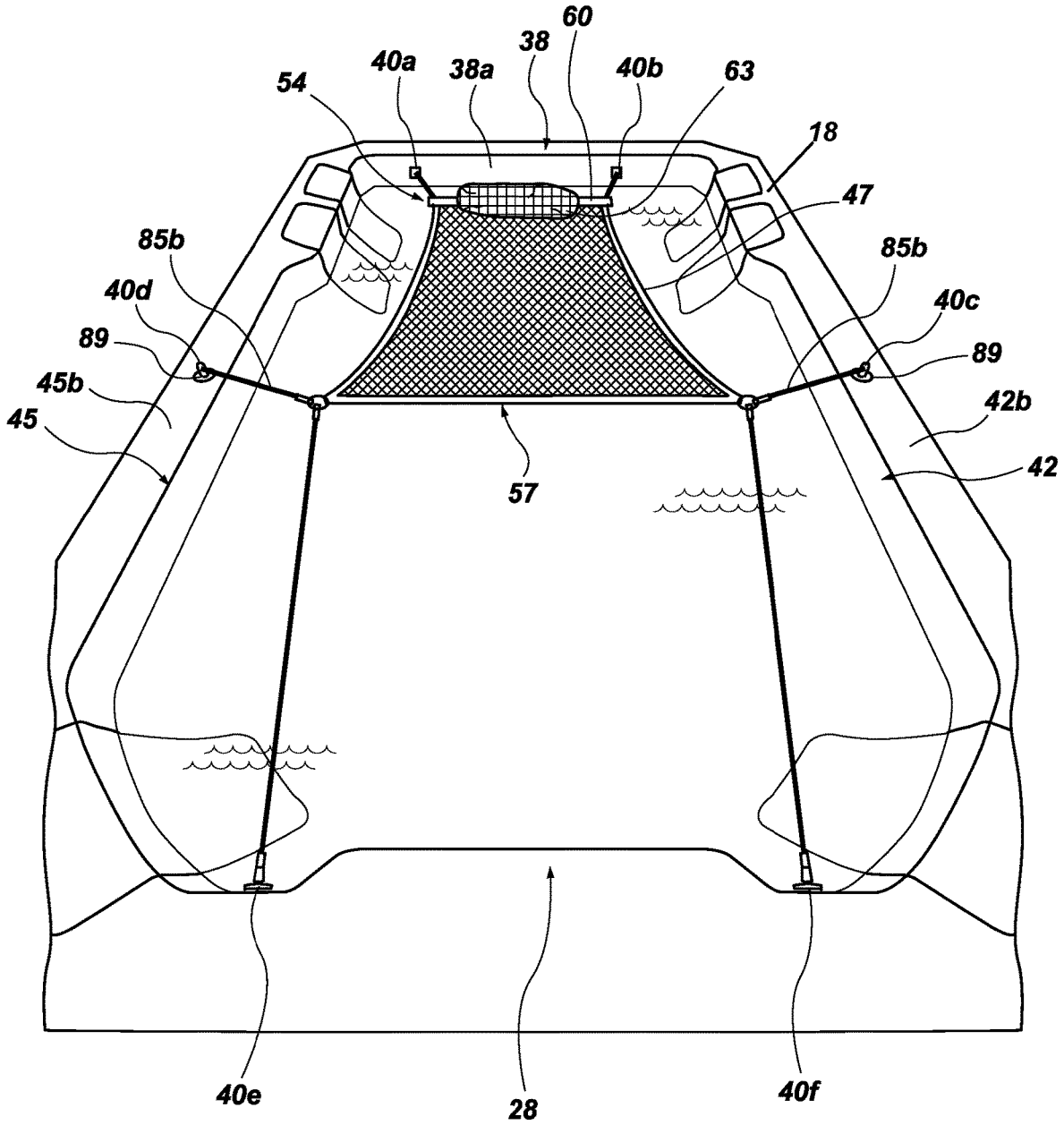
FIG. 2 is a top, back perspective view of the user support hammock system of FIG. 1.

FIGS. 1-2 show an exemplary system for a spa user support system 10. The system 10 may generally include a spa 15, and a hammock 20. In the configurations shown in FIGS. 1-2, the hammock 20 has a generally rectangular shape. Other shapes for the hammock 20, such as round, oval, or any other polygonal shape including trapezoidal, and triangular, etc., are also possible and contemplated herein. The hammock 20 may also have only two arching sides with a pointed ellipse or double-pointed teardrop shape. The scope of the disclosure is not limited to a hammock 20 of a specific shape, and all such shapes and sizes are contemplated. Similarly, the spa 15 shown in FIGS. 1-2 also has a generally rectangular shape. The hammock 20 as described herein may be used on spas and pools, or other bodies of water, of many different shapes and sizes. The rectangular hammock 20 and rectangular spa 15 shown in FIGS. 1-2 are shown by way of example and not limitation or exclusion of other shapes, sizes, and configurations for the hammock 20.

In the specific configuration shown in FIGS. 1-2, the spa 15 is a swim spa and has a front side 28 which may include one or more swim jets 33. In some configurations, the hammock 20 may be positioned such that a user's head is positioned towards the back side 38 (as shown in FIGS. 1-2) of the spa 15, which is opposite the front side 28 and therefore opposite the swim jets 33 which may create too much turbulence in the water for relaxing in the hammock 20. In other configurations, the user may place the hammock 20 such that their head is positioned towards the front side 28 and the swim jets 33 if desired.

The spa 15 may have include one or more anchors 40 attached to the sides of the spa 15. For example, one or more anchors 40 may be attached to the back side 38, the front side 28, the first lateral side 42, and/or the second lateral side 45 of the spa 15. The anchors 40 may be attached in any suitable manner. In some configurations, the anchors 40 may be removably attached to the spa 15. In other configurations, the anchors 40 may be non-removably attached to the spa 15. In the exemplary configuration shown in FIGS. 1-2, the anchors 40 are permanently attached to the spa 15 by being bolted directly through the shell of the spa 15. Other methods of attaching the anchors 40 to the spa 15 may also be used.

Any suitable type of anchors 40 for removably connecting the hammock 20 to the spa 15 may be used. For example, anchors 40 such as those manufactured by Swim Tether may be suitable. These types of anchors 40 comprise a sleeve 46 bolted to the shell of the spa 15. The sleeve 46 may receive a complementary pin 89 (FIG. 3) of an accessory to attach the accessory to the spa 15, as described in more detail below. Other suitable anchors 40 may also be used, such as anchors 40 that provide a ring, loop, or any other suitable attachment point for an accessory to be attached or connected to the anchor 40. Anchors 40 may also be used to attach other accessories to the spa 15, such as sport nets, swim tethers, etc.

In some configurations, the anchors 40 may be attached at specific locations on the spa shell, such as specific locations on the front side 28, back side 38, first lateral side 42, and/or second lateral side 45 of the spa 15. In other configurations, a plurality of anchors 40 may be attached to the spa sides 28, 38, 42, 45 at intervals such that a user may attach the hammock 20 or other accessories at a plurality of locations. For example, anchors 40 may be provided every 30 centimeters, every 60 centimeters, or every 90 centimeters on the spa shell.

In the configuration shown in FIGS. 1-2, the anchors 40 are placed at specific locations to optimize placement of the hammock 20 within the spa 15, such as to center the hammock 20 within the spa 15 and/or place the hammock 20 at the appropriate vertical position within the spa 15. For example, the anchor 40 placement may be optimized by both the horizontal and vertical placement of the anchor 40 on the spa 15.

In the specific configuration shown in FIGS. 1-2, back side 38 anchors 40*a* and 40*b* are located slightly wider than the width of the hammock 20, and are located on a vertical wall 38*a* (FIG. 2) of the back side 38 of the spa 15. In contrast, first lateral side 42 anchor 40*c* and second lateral side 45 anchor 40*d* are located on a horizontal lip 42*b* and 45*b*, respectively, of the first lateral side 42 and second lateral side 45 of the spa 15. Anchors 40 placed on the horizontal lips 42*b*, 45*b* of the spa 15 may be slightly raised compared to anchors 40 that are placed on a vertical wall 38*a* of the spa 15. Front side 28 anchors 40*e* and 40*f* are placed similar to back side 38 anchors, that is, slightly wider than the width of the hammock 20 and on a vertical wall 28*a* of the front side 28 of the spa 15. In other configurations, anchors 40 may be placed higher or lower on the spa 15, wider or narrower, on the vertical walls 38*a*, 28*a* or on the horizontal lips 42*b*, 45*b*, as desired. The placement of the anchors 40 as shown in FIGS. 1-2 may position a user on the hammock 20 such that they are located in the water of the spa 15 while using the hammock 20, but not fully submerged, and supported in a manner similar to a zero-gravity flotation experience.

Tethers 85 may extend from the hammock 20 to the anchors 40 and may be of a specified length. Alternatively, the tethers 85 may be adjustable to adjust the tautness of the hammock to fit a user's preference. The tethers 85 may be adjustable to certain positions or infinitely adjustable. Tether 85 configurations may vary by user and design to give the user the most favorable experience and as disclosed further herein.

Figure 5:
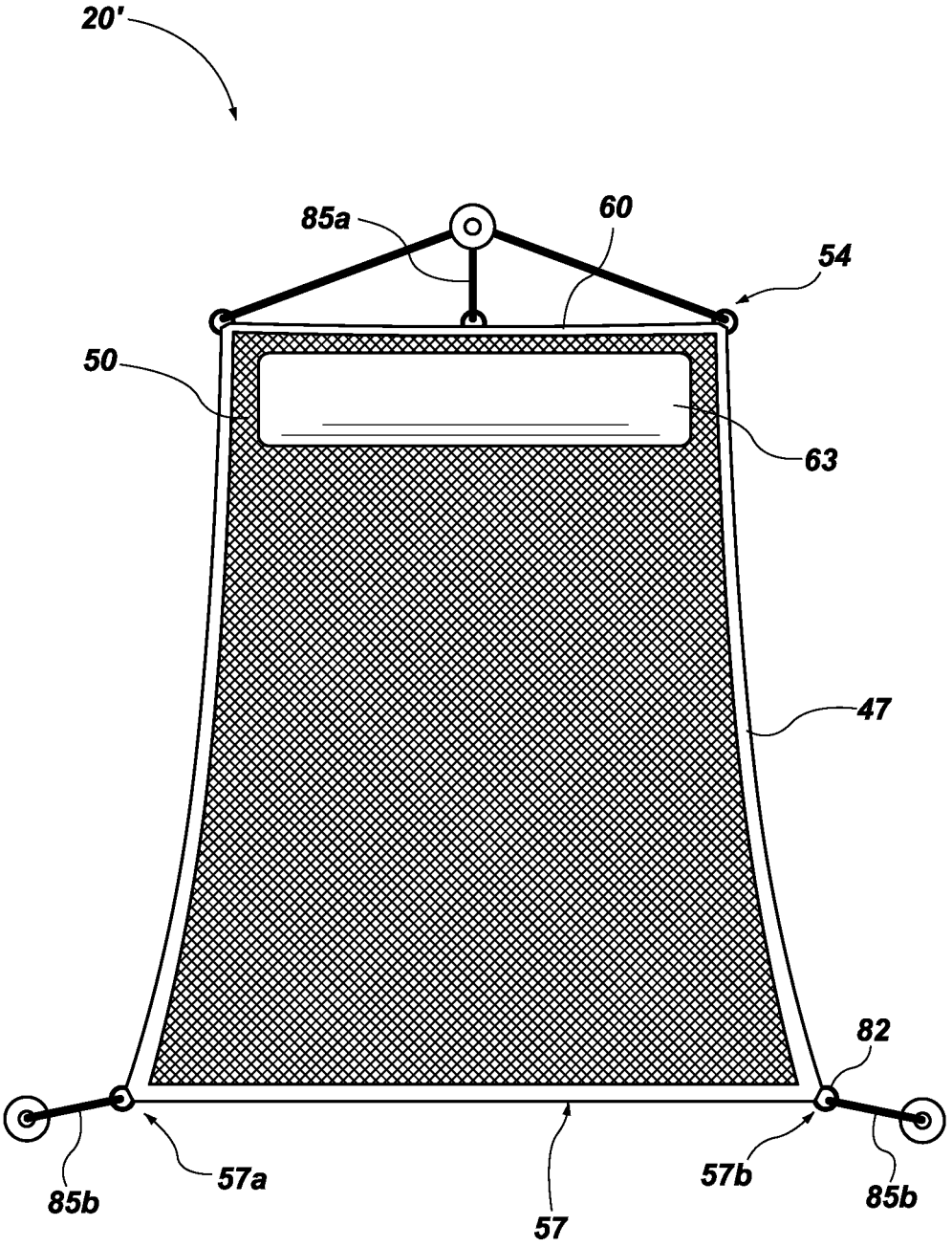
FIG. 5 is a top view of yet another alternate embodiment configuration of a hammock as disclosed herein.
Figure 6:
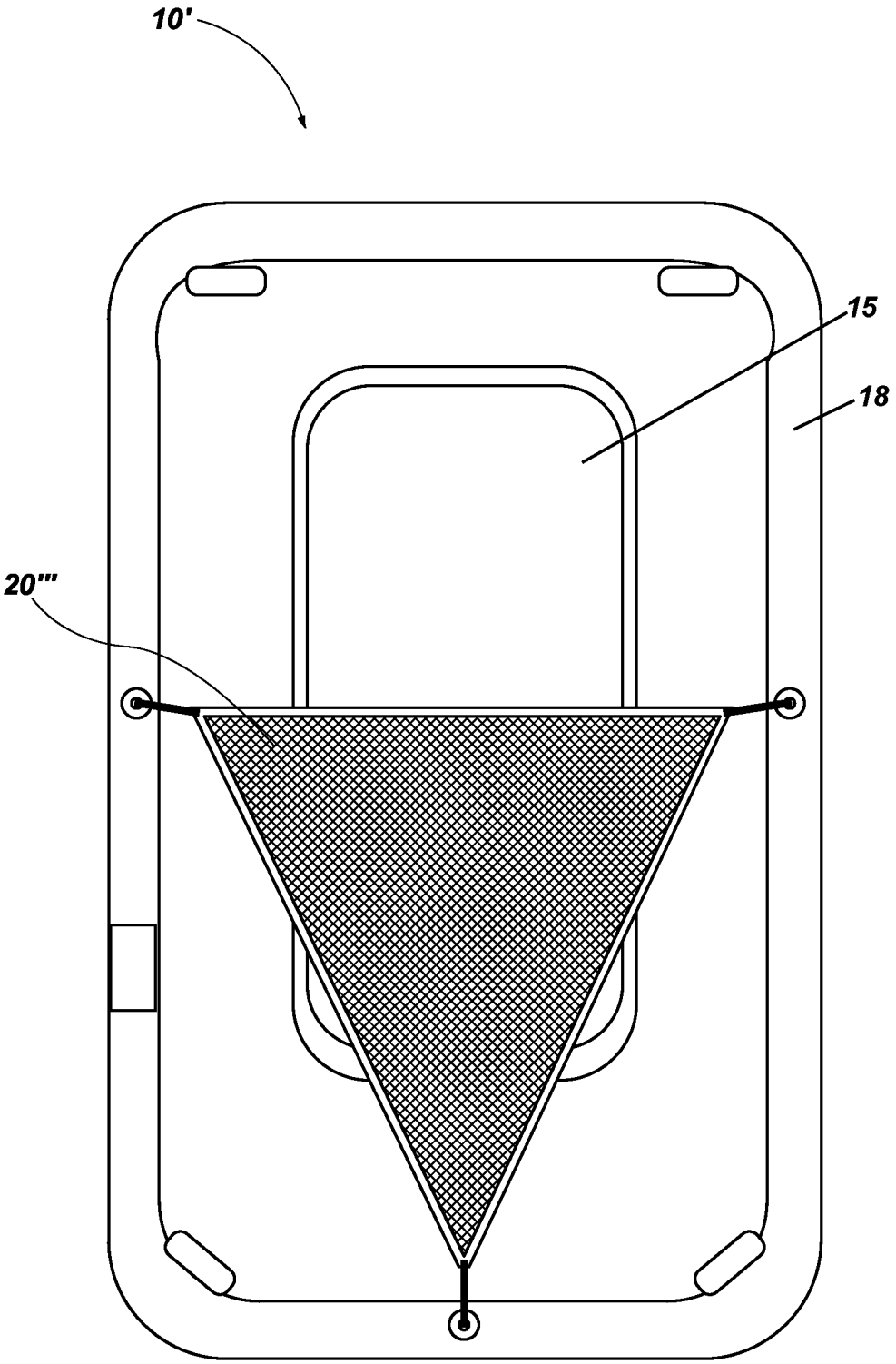
FIG. 6 is a top view of another alternate embodiment configuration of a user support hammock system as disclosed herein.
Figure 7:
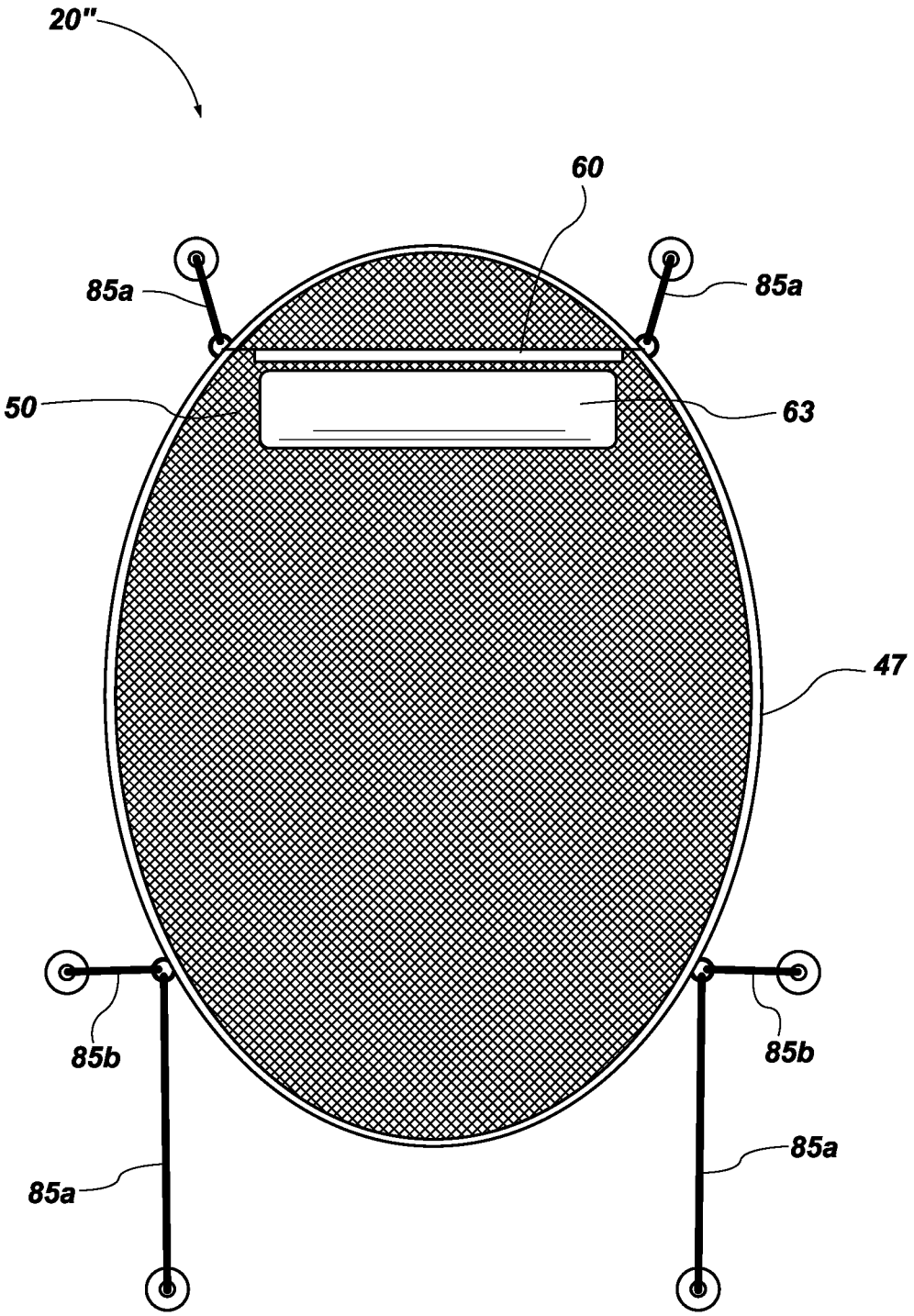
FIG. 7 is a top view of another alternate embodiment exemplary configuration of a hammock as disclosed herein.
Figure 8:
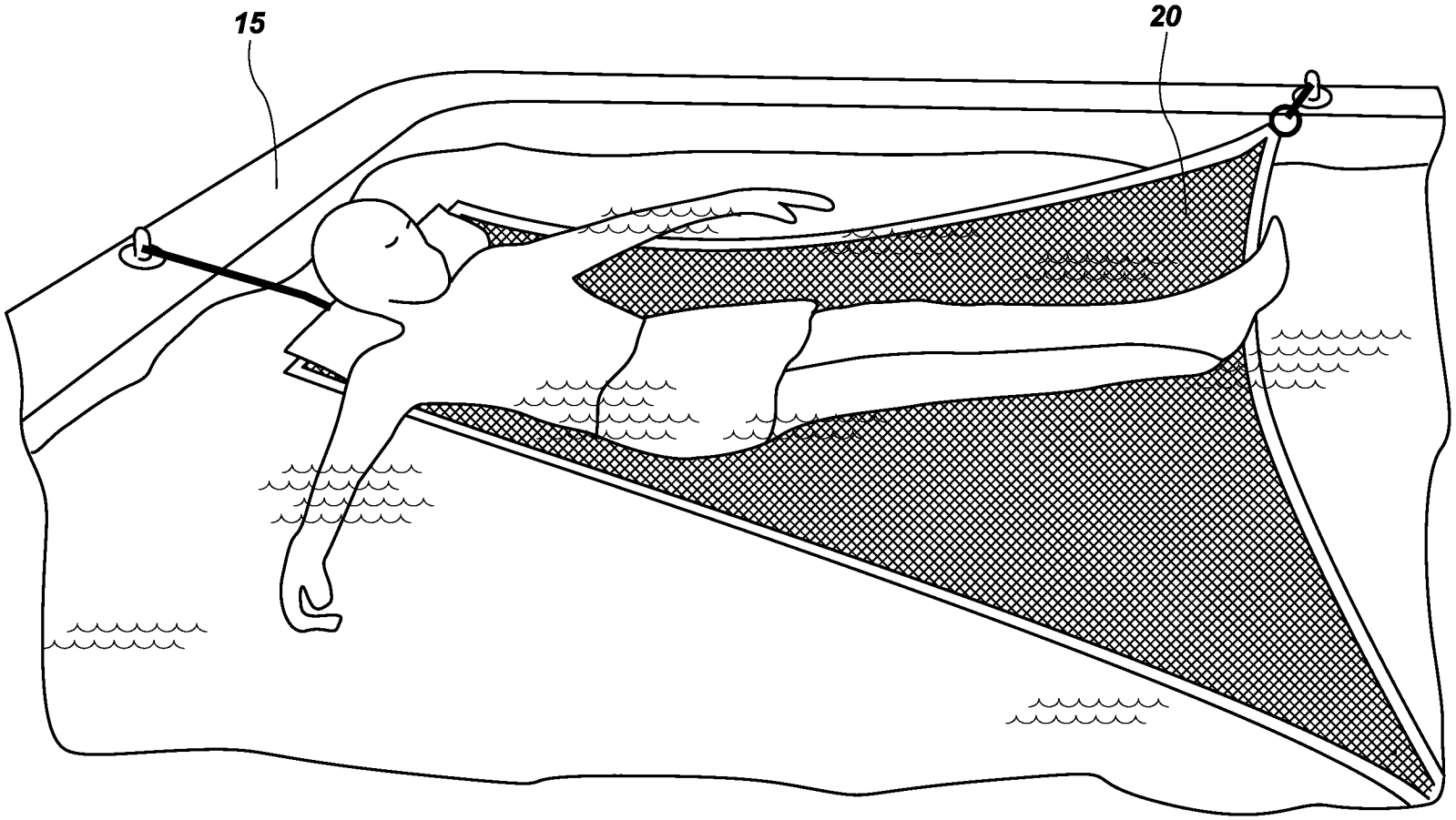
FIG. 8 is a perspective view of the embodiment of FIG. 5 in use.

The hammock 20 may have a variety of shapes, sizes, and configurations as desired. In some configurations, the hammock 20 may have a generally rectangular shape (FIGS. 1-2, 4), and be connected to the spa 15 at four or more points. In other configurations, the hammock 20 may have a generally triangular shape (FIGS. 5-6), and be connected to the spa 15 at three or more points. Other shapes, such as oval (FIG. 7), etc., are also possible and contemplated herein. In some configurations, the hammock 20 may have one or more catenary curves to optimize structural stress and stability.

The hammock 20 may be formed of any suitable type of material. In some configurations, a water permeable material may be used, such as a cotton, nylon, polymeric mesh, or another fabric with an open-weave design. An open weave, mesh, or other perforated material may minimize the effects of pooling water and deflection caused by fluctuating water current, and may also increase the safety of the use of the hammock 20. Other available materials may be suitable for alternative embodiments of the hammock 20. Examples are woven or non-woven materials formed of cotton, cotton blends, polymers, or any other similar materials. Those in the art will understand that any suitable material, now known or hereafter developed, may be used in forming the hammock 20 described herein.

In some configurations, a secondary material such as a woven strip of polyester, nylon, etc., may be secured to the edge, perimeter, or periphery of the hammock 20 to reinforce the structure and aid with load distribution. In these configurations, the secondary material may form a hammock frame 47. The hammock frame 47, as discussed above, may have any suitable shape and size, and may include catenary curves, etc., as described above.

The hammock 20 may also have any suitable dimensions as desired, and dimensions may vary based on both the size of the spa 15 and/or the size of the user. For example, the hammock 20 may have a width of about 150 centimeters to about 230 centimeters. In another configuration, the hammock 20 may have a width from about 170 centimeters to about 210 centimeters. Even more specifically, the hammock 20 may have a width of about 180 centimeters to 200 centimeters. The length of the hammock 20 may also similarly vary depending on the setting and/or the user. For example, the length of the hammock 20 may be about 150 centimeters to about 250 centimeters. More specifically, the length of the hammock 20 may be about 180 centimeters to about 220 centimeters. Even more specifically, the length of the hammock 20 may be about 190 centimeters to about 210 centimeters.

Figure 4:
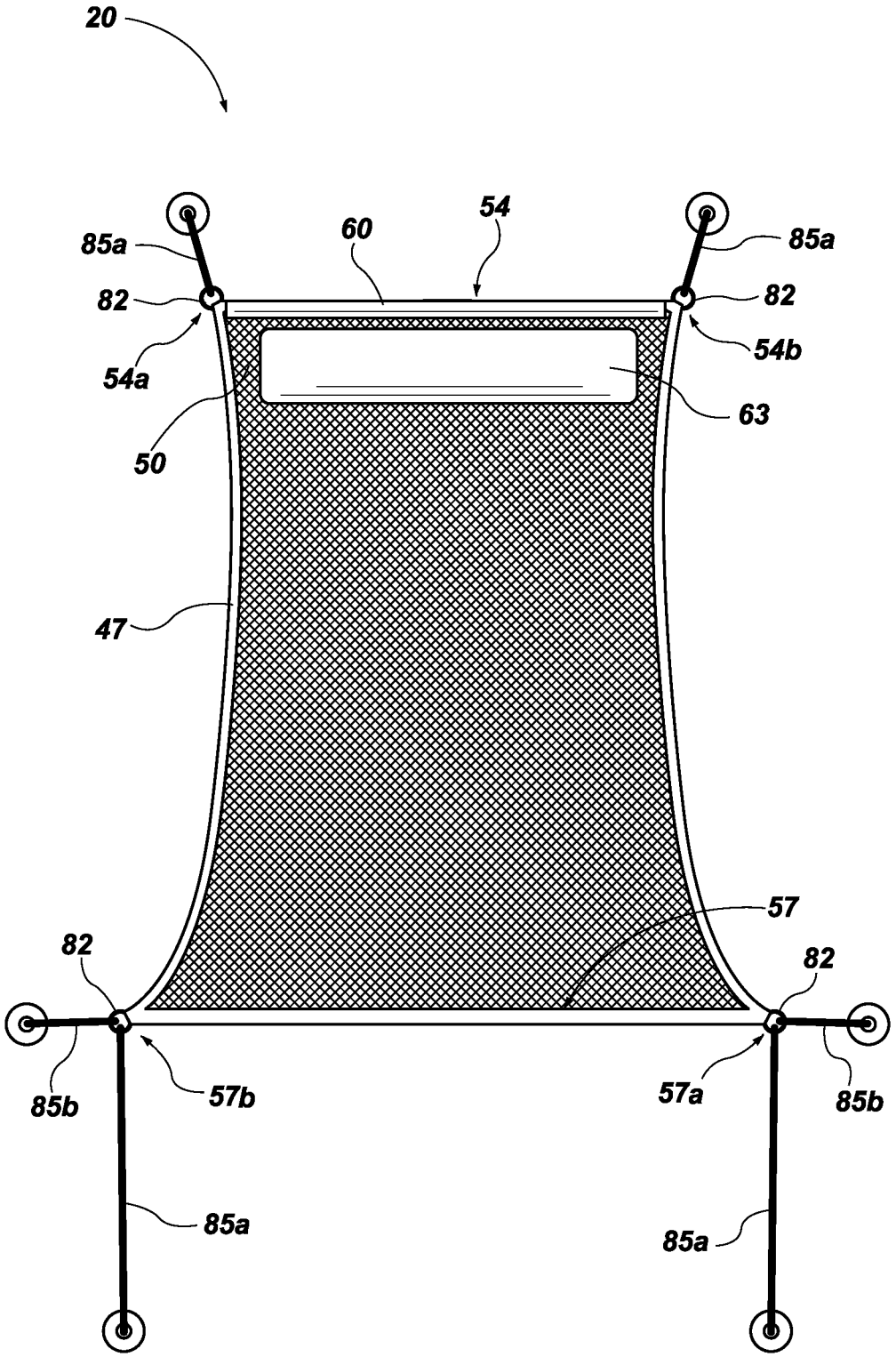
FIG. 4 is a top view of an alternate configuration of a hammock as disclosed herein.

In the exemplary configuration shown in FIG. 4, the hammock 20 is generally rectangular, with a head support portion 50 at a proximal end 54, with the proximal end 54 opposite a distal end 57. The head support portion 50 may also include one or more support members 60, such as a rigid support member, to provide further structure for the head support portion 50. In the configuration shown in FIG. 4, a single rigid support member 60 is shown. In other configurations, two or more support members 60 may be used. The support member 60 may be formed of rigid or substantially rigid material. In other configurations, the support member 60 may be formed of material that is flexible but still provides additional structure or shape to the head support portion 50 of the hammock 20. For example, closed or open-celled foam may be used. The support member 60 may serve to increase the rigidity or structure of the head support portion 50 while also providing flotation buoyance if needed. This may provide a user with a more relaxing experience as their head and/or neck is further supported in the hammock 20.

The head support portion 50 of the hammock 20 may also include a pillow member 63. The pillow member 63 may serve to support a user's head and/or neck, and may allow a user's head to be supported in an anatomically neutral position to preserve cervical spine alignment when the user is reclined in the hammock 20. Additionally, the pillow member 63 may provide buoyancy if desired.

The hammock 20 may also include corners or edges for connection to the spa shell. For example, as seen in FIG. 4, the proximal end 54 of the hammock 20 may include a first proximal corner 54*a* and a second proximal corner 54*b*. Similarly, the distal end 57 of the hammock 20 may include a first distal corner 57*a* and a second distal corner 57*b*. The corners of the hammock 20 may be used to connect the hammock 20 to anchors, such as anchors on a spa shell, anchors connected to a pool, etc.

The hammock 20 may further comprise means for connecting the hammock 20 to the anchors 40 of the spa 15. For example, one or more attachment means 82, such as a ring, loop, or other coupling mechanism, may be provided at a plurality of locations along the edge of the hammock 20. For hammocks 20 with a secondary material forming a frame 47, one or more attachment means 82 may be connected directly to the frame 47, such as at the corners of the frame 47. In some configurations, each corner of the hammock 20 may be provided with an attachment means 82. In other configurations, the attachment means 82 may be provided at other locations on the hammock 20. Alternatively, the attachment means 82 may maintain the tethers 85 that extend from the attachment means 82 to the anchors 40.

A coupling member or tether 85 may be provided to connect the attachment means 82 of the hammock 20 to the anchors 40 of the spa 15. One end of a coupling member 85 may be reversibly attached to the attachment means 82, and the other end of the coupling member 85 may be reversibly attached to an anchor 40 on the spa shell 15. In other configurations, a separate coupling member 85 need not be provided, and coupling member 85 may be directly attached to or integral with the hammock 20.

Figure 3:
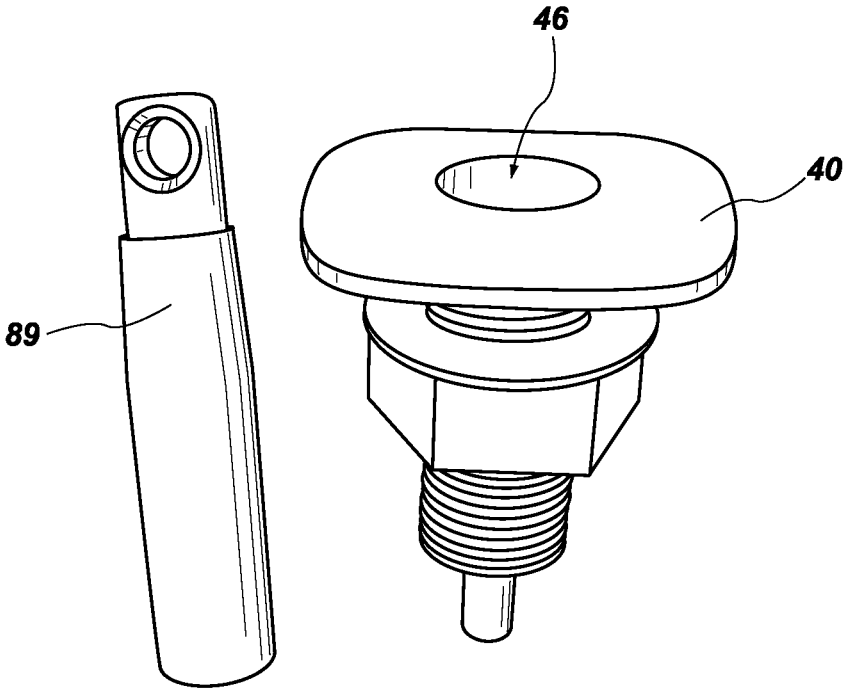
FIG. 3 is a perspective view of an anchor and pin as disclosed herein.

Coupling members 85 may be formed from any suitable material. For example, coupling members 85 may be formed of an elastic material or a material that has flexibility. For example, nylon webbing, or a natural or synthetic latex rubber, may be used to form coupling members 85. An elastic material may allow the hammock 20 to hang at different vertical positions depending on the weight of the user. For example, a user with a larger mass may be able to hang lower in the hammock 20 than a user with a smaller mass when coupling members 85 are formed with elastic material(s). Coupling members 85 may have an attachment point at each end, such as a carabiner or other coupling link, that allow the coupling members 85 to be connected to an attachment means 82 of the hammock 20 at one end, and an anchor 40 of the spa 15 at the other end. In some configurations, for example, a coupling member 85 may include a coupling link at a first end, and a pin 89 at a second end. The pin 89 may be configured to be selectively inserted into a sleeve 46 of an anchor 40 (see FIG. 2, showing pins 89 inserted into sleeves 46 of anchors, and FIG. 3 showing a pin 89 next to anchor 40).

In some configurations, the hammock 20 is attached to the spa 15 such that the hammock 20 does not sway, or such that sway of the hammock 20 is limited. That is, the hammock 20 is limited in its side-to-side, left-to-right, or lateral motion. This connection may allow a user to be supported in the water such that they float in one position with minimal movement, and may provide a relaxation experience similar to zero gravity flotation. Zero gravity flotation is known to have a number of health benefits, including the ability to relieve stress, ease muscle tension and pain, and improve mood.

In configurations where the hammock 20 is attached to the spa 15 such that sway of the hammock 20 is limited, four or more connection points may be used to connect the hammock 20 to the spa 15. In some configurations, six or more connection points may be used to connect the hammock 20 to the spa 15. At least two or more of the connection points may be in the lateral direction, such that the hammock 20 is pulled in both lateral directions to limit lateral movement of the hammock 20. At least two or more of the connection points may be in the longitudinal direction such that the hammock 20 is pulled in both longitudinal directions to limit longitudinal movement of the hammock 20.

In the specific configuration shown in FIGS. 1-2, six connection points are used to ensure the hammock 20 does not sway, but rather stays substantially in place while in use. Two longitudinal connection points are used to attach the head support portion 50 to the back side 38 of the spa via longitudinal coupling members 85*a*. Two longitudinal and two lateral connection points, for a total of four connection points, are used to attach the distal end 57 to the first lateral side 42, second lateral side 45, and front side 28 of the spa.

As seen best in FIG. 4, in this exemplary configuration, the hammock 20 may be provided with two attachment means 82 connected to the frame 47 at the distal end 57 of the hammock 20, one on each distal corner 57*a*, 57*b*. Two coupling members 85 may be attached to each attachment means 82. The first coupling member may be a lateral coupling member 85*b* to attach from the distal corners 57*a*, 57*b* to the lateral sides of the spa shell, respectively. The second coupling member may be a longitudinal coupling member 85*a* and may attach about 90 degrees away from the lateral coupling member 85*b*, and may attach the distal corners 57*a*, 57*b* to the front side 28 of the spa shell. Other configurations are also possible to limit sway of the hammock 20 to achieve a peaceful user experience. Or, in configurations where sway is desired, the connection points between the hammock 20 and the spa 15 may be optimized to allow sway.

In use, a user may first select a hammock 20 as desired. The hammock 20 may be selected based on a user's preference for the shape and size of the hammock, based on the shape and size of the spa 15 being used, and/or based on the size of the user. In some configurations, the hammock 20 may be provided in a plurality of shapes and sizes. In other configurations, a single, standard-sized hammock 20 may be provided and may include one or more means to adjust (such as by shortening the length of one or more coupling members 85) the position of the hammock 20.

After the hammock 20 is selected, a user may then attach the hammock 20 to the anchors 40 of the spa 15 or pool. For example, a user may attach a first end of a first lateral coupling member 85*a* to an attachment means 82 of a first proximal corner 54*a*, and the user may attach the second end of the first longitudinal coupling member 85*a* to an anchor 40*a* on the spa 15. Similarly, the user may attach a first end of a second longitudinal coupling member 85*a* to an attachment means 82 of a second proximal corner 54*b*, and the user may attach the second end of the second longitudinal coupling member 85*a* to an anchor 40*b* on the spa 15. The height of the anchors 40 on the vertical wall of the spa 15 may assist in properly positioning a user's head slightly above the water while their body is submerged and floating in a supported manner in the water.

The user may then connect the attachment means 82 of the distal corners 57*a*, 57*b* to one or more coupling members. In some configurations, a single lateral coupling member 85*b* may be used at each distal corner 57*a*, 57*b*. In other configurations, a lateral coupling member 85*b* plus a longitudinal coupling member 85*a* may be used at each distal corner 57*a*, 57*b* to limit sway of the hammock 20 in use.

With the hammock 20 connected to the spa 15, a user may then recline their body on the hammock 20, and position their head on the pillow member 63 as desired. The user may be supported in the water of the spa 15 or pool in a similar manner to zero gravity flotation. Water may freely flow around the user through the permeable fabric of the hammock 20. Zero gravity flotation, or a simulation of zero gravity flotation, is typically achieved with water that contains a high quantity of salt so the user has the "feel" of floating more easily. According to the present disclosure, a hammock is provided to give the user the "feel" of floating more easily. Thus, the user floats in the water of the spa 15 under the buoyancy force of the water pushing up against the user's body, with the hammock 20 providing additional support so the user feels they are floating more easily and can completely relax in the floating position.

Zero gravity flotation may also be described as "supported flotation." That is, the user is floating under the buoyancy force of the water pushing up against the user's body, and also provided with the additional support of the hammock 20. The hammock 20 is not designed to carry the full weight of the user such that the user's weight is supported by the hammock 20, but rather a bulk of the user's weight is supported by the buoyancy force of the water, with the hammock 20 providing an additional support so the user can comfortably float in a supine position in the water of the spa or pool.

Aspect A: A spa user support system comprising: a swim spa comprising a generally rectangular shell, the generally rectangular shell comprising a front side having at least one swim jet in connection therewith, and a back side opposite the front side, with a first lateral side between the front side and the back side and a second lateral side opposite the first lateral side and between the front side and the back side; a first anchor permanently attached to the generally rectangular shell; a second anchor permanently attached to the generally rectangular shell; a user support hammock, the user support hammock having at least two sides, a first side comprising a head support portion, the user support hammock for supporting a user while the user floats in the water of the swim spa under a buoyant force of the water of the swim spa against the user, the first side in connection with a first attachment means for attaching the first side to the first anchor; a second side of the user support hammock in connection with a second attachment means for attaching the second side to the second anchor.

Aspect B: The spa user support system of Aspect A, further comprising a third anchor permanently attached to the generally rectangular shell and a third side of the user support hammock in connection with a third attachment means for attaching the third side to the third anchor, wherein the first anchor comprises an attachment loop, the second anchor comprises a first sleeve, and the third anchor comprises a second sleeve; the first side of the user support hammock comprising an attachment member for attachment to the attachment loop of the first anchor; the second side of the user support hammock in connection with a first pin, the first pin receivable within the first sleeve of the second anchor; and the third side of the user support hammock in connection with a second pin, the second pin receivable within the second sleeve of the third anchor.

Aspect C: The spa user support system of Aspects A or B, wherein the user support hammock has a generally triangular shape with a head support portion at a first corner, the first corner further comprising a loop for attachment to a longitudinal coupling member; a second corner of the user support hammock comprising a loop for attachment to a first lateral coupling member; and a third corner of the user support hammock comprising a loop for attachment to a second lateral coupling member.

Aspect D: The spa user support system of any of Aspects A through C, wherein the user support hammock has a generally rectangular shape, and wherein the swim spa further comprises a fourth anchor permanently attached to the back side of the spa, such that the head support portion is connectable via a first longitudinal coupling member to the first anchor of the back side of the swim spa, and is further connectable via a second longitudinal coupling member to the fourth anchor of the back side of the swim spa.

Aspect E: The spa user support system of any of Aspects A through D, wherein the first anchor is permanently attached to the back side by being bolted directly through the generally rectangular shell.

Aspect F: The spa user support system of any of Aspects A through E, wherein the user support hammock comprises a water permeable material.

Aspect G: The spa user support system of any of Aspects A through F, wherein the head support portion comprises at least one support member to increase rigidity of the head support portion.

Aspect H: The spa user support system of any of Aspects A through G, wherein the head support portion further comprises a pillow member to support a user's head.

Aspect I: The spa user support system of any of Aspects A through H, wherein the support hammock is attached to at least six anchors on the generally rectangular spa shell to limit swaying of the support hammock in use.

Aspect J: The spa user support system of any of Aspects A through I, wherein the system further comprises a fourth anchor permanently attached to the back side of the generally rectangular shell, a fifth anchor attached to the front side of the generally rectangular shell, and a sixth anchor attached to the front side of the generally rectangular shell.

Aspect K: The user support system of any of Aspects A through J, wherein the first anchor is attached to a vertical wall of the back side, the second anchor is attached to a horizontal lip of the first lateral side, the third anchor is attached to a horizontal lip of the second lateral side, the fourth anchor is attached to the vertical wall of the back side, the fifth anchor is attached to a vertical wall of the front side, and the sixth anchor is attached to the vertical wall of the front side.

Aspect L: The user support system of any of Aspects A through K, wherein the first attachment means comprises a longitudinal coupling member, and the second and third attachment means each comprise a lateral coupling member.

Aspect M: The spa user support system of any of Aspects A through L, wherein the support hammock is attached to at least two longitudinal coupling members and at least two lateral coupling members to limit swaying of the support hammock in use.

Aspect N: A spa user support system comprising: a swim spa comprising a shell, the shell comprising a front side and a back side opposite the front side, with a first lateral side between the front side and the back side, and a second lateral side opposite the first lateral side and between the front side and the back side; a first anchor and a second anchor attached to the back side; a third anchor attached to the first lateral side; a fourth anchor attached to the second lateral side; a fifth anchor and a sixth anchor attached to the front side; a generally rectangular user support hammock, the user support hammock comprising a head support portion at a proximal end, the proximal end comprising a first attachment means at a first proximal corner for connection to the first anchor, and a second attachment means at a second proximal corner for connection to the second anchor, a distal end opposite the proximal end, the distal end comprising a first attachment means at a first distal corner for connection to the third anchor of the first lateral side and the fifth anchor of the front side, and a second attachment means at a second distal corner for connection to the fourth anchor of the second lateral side and the sixth anchor of the back side.

Aspect O: The spa user support system of Aspect N, wherein the first anchor and second anchor are attached to a vertical wall of the back side, the third anchor is attached to a horizontal lip of the first lateral side, the fourth anchor is attached to a horizontal lip of the second lateral side, and the fifth and sixth anchors are attached to the vertical wall of the back side.

Aspect P: A spa user support system comprising: a user support hammock for a user to rest thereon in the water of the spa, the user support hammock comprising a head support portion at a proximal end, the proximal end comprising a first attachment means at a first proximal corner for longitudinal connection to a first anchor on a first end of a spa shell; a distal end opposite the proximal end, the distal end comprising a first attachment means at a first distal corner for connection to a second anchor on a first lateral side of the spa shell, and a second attachment means at a second distal corner for connection to a third anchor on a second lateral side of the spa shell.

Aspect Q: The spa user support system of Aspect P, wherein the hammock has a generally rectangular shape, and wherein the proximal end comprises a second attachment means at a second proximal corner for connection to a fourth anchor on the first end of the spa shell.

Aspect R: The spa user support system of Aspects P or Q, wherein the first attachment means comprises a longitudinal coupling member, the second attachment means comprises a first lateral coupling member, and the third attachment means comprises a second lateral coupling member.

Aspect S: The spa user support system of any of Aspects P through R, wherein the second attachment means further comprises a second longitudinal coupling member, and wherein the third attachment means comprises a third longitudinal coupling member, such that the hammock may be attached to at least 6 points to a spa to limit swaying of the hammock in use.

Aspect T: The spa user support system of any of Aspects P through S, wherein the head support portion comprises at least one support member to increase rigidity of the head support portion.

Although the foregoing disclosure provides many specifics, such as use of the system in spas, it will be appreciated that pools, and other water holding devices are contemplated and these should not be construed as limiting the scope of any of the ensuing claims. Other embodiments and configurations may be devised which do not depart from the scopes of the claims. Features from different embodiments and configurations may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

The invention claimed is:

1. A spa user support system comprising:

a swim spa comprising a shell, the shell comprising a front side, and a back side opposite the front side, with a first lateral side between the front side and the back side and a second lateral side opposite the first lateral side and between the front side and the back side;

a first anchor and a second anchor attached to the back side;

a third anchor attached to the first lateral side;

a fourth anchor attached to the second lateral side;

a fifth anchor and a sixth anchor attached to an interior wall of the front side; and a user support hammock, the user support hammock comprising a head support portion at a proximal end, the proximal end comprising a first attachment means at a first proximal corner for connection to the first anchor, and a second attachment means at a second proximal corner for connection to the second anchor, a distal end of the user support hammock opposite the proximal end, the distal end comprising a first attachment means at a first distal corner for connection to the third anchor of the first lateral side and the fifth anchor of the front side, and a second attachment means at a second distal corner for connection to the fourth anchor of the second lateral side and the sixth anchor of the front side.

2. The spa user support system of claim 1, wherein the first anchor and second anchor are attached to a vertical wall of the back side, the third anchor is attached to a horizontal lip of the first lateral side, the fourth anchor is attached to a horizontal lip of the second lateral side, and the fifth and sixth anchors are attached to a vertical wall of the front side.

3. The spa user support system of claim 1, wherein the first anchor is permanently attached to the back side by being bolted directly through the shell.

4. The spa user support system of claim 1, wherein the user support hammock has a first width and a distance between the first and second anchors permanently attached to an interior of the shell is greater than the first width to simulate a zero gravity flotation experience for a user.

5. The spa user support system of claim 1, wherein the head support portion comprises at least one support member to increase rigidity of the head support portion.

6. The spa user support system of claim 1, wherein the head support portion further comprises a pillow member to support a user's head.

7. The spa user support system of claim 1, wherein the support hammock has limited swaying in use to simulate a zero-gravity floatation.

8. The user support system of claim 1, wherein the first anchor is attached to a vertical wall of the back side, the second anchor is attached to the vertical wall of the back side, the third anchor is attached to a horizontal lip of the first lateral side, the fourth anchor is attached to the a horizontal lip of the second lateral side, the fifth anchor is attached to a vertical wall of the front side, and the sixth anchor is attached to the vertical wall of the front side.

9. The user support system of claim 1, wherein the first attachment means comprises a longitudinal coupling member, and the second attachment means each comprise a lateral coupling member.

10. The spa user support system of claim 1, wherein the support hammock is attached to at least two longitudinal coupling members and at least two lateral coupling members to limit swaying of the support hammock in use.

11. A spa user support system comprising:

a spa comprising a shell having a front side with at least one jet in connection therewith, and a back side opposite the front side, with a first lateral side between the front side and the back side and a second lateral side opposite the first lateral side and between the front side and the back side;

a first anchor and a second anchor attached to the back side of the shell, a first distance between the first anchor and the second anchor;

a third anchor and a fourth anchor attached to an interior wall of the front side of the shell;

a fifth anchor attached to the first lateral side;

a sixth anchor attached to the second lateral side; and a user support hammock comprising a head support portion at a first side, the user support hammock for supporting a user while the user floats in the water of the spa under a buoyant force of the water of the swim spa against the user, a first side of the user support hammock in connection with the first anchor and the second anchor, the first side of the user support hammock having a first width, the first width being less than the first distance between the first anchor and the second anchor to simulate a zero gravity flotation experience while the user floats in the water of the swim spa, and a second side of the user support hammock in connection with the third anchor and the fourth anchor.

12. The spa user support system of claim 11, wherein the first anchor comprises an attachment loop for attachment to a first attachment means, the first attachment means comprising a longitudinal coupling member.

13. The spa user support system of claim 11, wherein the second side comprises a first attachment means at a first proximal corner for connection to the first anchor, and a second attachment means at a second proximal corner for connection to the second anchor, and wherein the first attachment means comprises a longitudinal coupling member, and the second attachment means comprises a first lateral coupling member.

14. The spa user support system of claim 13, wherein the hammock has at least six attachment points to the spa to limit swaying of the hammock in use.

15. The spa user support system of claim 11, wherein a width of the second side of the hammock is narrower than a width between the third anchor and the fourth anchor.

* * * * *